United States Patent [19]

Tsabar

[11] Patent Number: 5,016,762

[45] Date of Patent: May 21, 1991

[54] MULTIPLE-FEED CLOTHESLINE DRYING APPARATUS

[76] Inventor: Rafi Tsabar, 33 Ussishkin St., Ramat Hasharon, Israel

[21] Appl. No.: 340,364

[22] Filed: Apr. 19, 1989

[30] Foreign Application Priority Data

Jan. 18, 1989 [IL] Israel ..... 88983

[51] Int. Cl.[5] ..... D06F 53/00

[52] U.S. Cl. ..... 211/119.1; 211/1.5; 160/265; 242/100

[58] Field of Search ..... 211/119.01-119.09, 211/119.1-119.18, 1.5; 242/100, 100.1; 160/265, 68

[56] References Cited

U.S. PATENT DOCUMENTS

| | | | |
|---|---|---|---|
| 2,989,267 | 6/1961 | Mehl | 211/119.51 X |
| 3,096,884 | 7/1963 | Leshner | 211/119.15 |

FOREIGN PATENT DOCUMENTS

| | | | |
|---|---|---|---|
| 2310598 | 9/1973 | Fed. Rep. of Germany | 160/265 |
| 654331 | 6/1963 | Italy | 211/119.01 |
| 3073997 | 4/1988 | Japan | 211/119.01 |
| 85/00633 | 2/1985 | PCT Int'l Appl. . | |

*Primary Examiner*—Sarah A. Lechok

*Attorney, Agent, or Firm*—Edward Langer

[57] ABSTRACT

A multiple-feed clothesline drying apparatus constructed as a plurality of clotheslines arranged for coordinated movement within the drying space enclosed by a frame, so as to simultaneously make additional drying space available. The apparatus is constructed as a stationary frame provided as a rectangular shape having a shaft mounted at one end. One end of each of a plurality of clotheslines is wound about the shaft on portions of its length, and are thereby retained in a storage position. The other end of each of the plurality of clotheslines terminates on a movable bar which is disposed within the frame area. At either end of the movable bar, a pair of cords are connected, each looped around a pulley supported at the other end of the frame and wound about the shaft in a direction opposite that of the clotheslines. The cords can be used to adjust the position of the movable bar, which moves toward and away from the shaft in accordance with take-up and feed operations, simultaneously feeding and retracting multiple clotheslines in coordinated fashion. A motor drive mechanism is provided for automatic feeding or retracting the multiple clotheslines. The clothesline shaft is provided with an inner shaft allowing all the clotheslines to be tightened against the cords as needed. An automatically fed rain cover is provided to cover the frame area and the clotheslines.

14 Claims, 7 Drawing Sheets

45
48
22
46
26

45
12
91
48
91
94
22
46
12

45
94
96
50
92
48
96
94
50
22
46
42

MULTIPLE-FEED CLOTHESLINE DRYING APPARATUS

CROSS-REFERENCE TO RELATED APPLICATIONS

The present application is related to four concurrently filed patent applications by the same inventor, which are entitled "DRUM-TYPE CLOTHESLINE DRYING APPARATUS" Ser. No. 340,465, now abandoned, "CONVEYOR-TYPE CLOTHESLINE DRYING APPARATUS" Ser. No. 340,478, now abandoned, "ENDLESS LOOP-TYPE CLOTHESLINE DRYING APPARATUS" Ser. No. 340,504, now abandoned, and "HEIGHT-ADJUSTABLE CLOTHESLINE DRYING APPARATUS" Ser. No. 340,479, now abandoned, the disclosures of which are incorporated herein by reference.

FIELD OF THE INVENTION

The present invention relates to clothesline drying apparatus, and more particularly, to a new and useful clothesline drying rack arranged to provide multiple clotheslines with coordinated movement, simultaneously presenting a user with additional drying space.

BACKGROUND OF THE INVENTION

The prior art of clothesline drying apparatus includes many varied constructions designed to support a clothesline by use of a rigid or collapsible frame. Examples of these constructions are disclosed by the following patents:

U.S. Pat. No. 4,732,285 to Wuster;
U.S. Pat. No. 4,717,107 to Servadio;
U.S. Pat. No. 4,592,472 to Carnera;
U.S. Pat. No. 4,434,898 to McCarthy;
U.S. Pat. No. 3,978,988 to Friedeberg;
U.S. Pat. No. 3,732,987 to Adams;
U.S. Pat. No. 3,675,785 to Martin;
U.S. Pat. No. 3,335,873 to Lowe;
U.S. Pat. No. 3,215,279 to Leo;
U.S. Pat. No. 3,206,037 to Woolsey;
U.S. Pat. No. 3,164,258 to Cavalleri;
U.S. Pat. No. 3,145,965 to Stein;
U.S. Pat. No. 3,139,190 to Shore;
U.S. Pat. No. 3,075,648 to Bereza;
Israel Patent No. 65716 to Shani et al.;
Israel Patent No. 53613 to Hills Industries Ltd.;
Israel Patent No. 41103 to Wiener;
Israel Patent No. 20226 to Aarons;
Israel Patent No. 21429 to Meron;
Israel Patent No. 17856 to Ben Zvi et al.; and
Israel Patent No. 20041 to Lazari et al.

Other known clothesline drying apparatus constructions relate to pulley arrangements and retractable or hidden clotheslines, which may be withdrawn from a receptacle when needed and returned thereto automatically under spring tension. Examples of these constructions include the following patents:

U.S. Pat. No. 4,684,076 to Stamper;
U.S. Pat. No. 4,470,558 to Stamper;
U.S. Pat. No. 3,750,891 to Decorato;
U.S. Pat. No. 3,389,808 to Cavalleri;
U.S. Pat. No. 3,263,939 to Menken;
U.S. Pat. No. 3,193,212 to Lotta;
U.S. Pat. No. 3,190,455 to Hartshorn et al.; and
U.S. Pat. No. 3,189,323 to Kliss.

In U.S. Pat. Nos. 3,477,660 to Abraham and 3,173,548 to Hesener, there are disclosed multi-line structures in which a plurality of clotheslines is dispensed from a spring-loaded roller. Spring tension adjustment is provided to reduce line sag, but this involves complicated spring mounting arrangements within the roller and eventual spring fatigue, reducing effectiveness.

In applications where clothesline drying apparatus is placed outside an apartment balcony or porch, a common feature of all prior art constructions is that the rack or frame is generally stationary. A plurality of clotheslines are mounted in parallel orientation, each looped about a pair of pulleys allowing for movement independent of the other clotheslines, by a grasping and pulling motion of the hand.

In the common arrangement, in which several clotheslines are placed side by side on a horizontal frame, the individual clotheslines supported by a pair of pulleys are generally provided with a degree of slack. Thus, adjacent clotheslines tend to interfere with each other, and are therefore not placed close together. This results in an ineffective utilization of the clothesline drying space available.

In addition, the lower run of the loop is often in contact with wash items hanging from the upper run, and this tends to interfere with smooth movement of the loop. In many cases, the loop does not move at all since the pulleys have become rusted after long exposure to the rain, and the loop material itself is dried and no longer readily flexible. Thus, the user is required to reposition along the clothesline length while hanging out or removing the laundry, in order to reach all of the available drying area, and this involves a great deal of body motion.

Therefore, it would be desirable to provide clothesline drying apparatus which more effectively utilizes the drying space which it occupies, eliminates hard-to-reach clothesline drying areas, and generally simplifies the task of hanging the laundry to dry and removing it.

SUMMARY OF THE INVENTION

Accordingly, it is a principal object of the present invention to overcome the above-mentioned disadvantages and provide a multiple-feed clothesline drying apparatus which is constructed as a plurality of clotheslines arranged for coordinated movement within the drying space enclosed by a frame, so as to simultaneously make additional drying space available.

It is another object of the present invention to maximize the usable drying space in a given frame area, by provision of means for tightening each of the plurality of clotheslines, avoiding interference between them.

In accordance with a preferred embodiment of the invention, there is provided multiple-feed clothesline drying apparatus comprising:

a shaft supported for rotation at the ends thereof;

a plurality of clotheslines each having an end wound about a portion of said shaft along the length thereof;

means for retaining the other end of each of said clotheslines, said retaining means having attached to at least one point thereon one end of a flexible length, the other end of said flexible length being supported in looped fashion apart from said shaft and being wound about said shaft in opposite sense to that of said clotheslines such that said retaining means moves toward and away from said shaft in accordance with respective take-up and feed operations thereof; and drive means operable to rotate said shaft in said take-up and feed operations for simultaneously retracting and feeding said plurality of clotheslines in coordinated fashion.

In the preferred embodiment, the multiple-feed clothesline drying apparatus is constructed as a stationary frame for mounting on an existing outdoor balcony drying rack. The stationary frame is preferably provided as a rectangular shape having a shaft mounted at one end. One end of each of a plurality of clotheslines is wound about the shaft on portions of its length, and are thereby retained in a storage position.

The other end of each of the plurality of clotheslines terminates on a movable bar which is disposed within the frame area. At either end of the movable bar, there are connected a pair of cords, each of which is looped around a pulley supported at the other end of the frame. The free end of each cord is wound about the shaft in a direction opposite that of the clotheslines. In this fashion, the cords can be used to adjust the position of the movable bar, which moves toward and away from the shaft in accordance with take-up and feed operations. As a result, multiple clotheslines are simultaneously fed and retracted in coordinated fashion.

A motor drive mechanism is also provided for rotation of the shaft, enabling adjustment of the movable bar by movement of the cords, to feed or retract the multiple clotheslines with a minimum of effort. Thus, multiple clothesline drying space is brought to the user, simplifying the task of hanging and removing laundry items. Since the clotheslines are spaced apart along the length of the shaft and the movable bar, the available drying space is more effectively utilized. Each clothesline termination is adjustable to maintain adjacent clotheslines taut, eliminating interference with one another.

Also in the preferred embodiment, the clothesline shaft is provided with an inner shaft capable of independent rotation in one direction only, by use of a ratchet arrangement. Rotation of the inner shaft allows all of the clotheslines to be tightened against the cords as needed, in one simple adjustment.

A feature of the invention is the provision of a rain cover which is coiled about a second shaft supported by the frame end opposite that of the first clothesline shaft. The second shaft carries the cord loop, so that it rotates in a direction opposite that of the first shaft. As the clotheslines are fed from the first shaft into the frame area, the rain cover is automatically fed in the opposite direction, ultimately covering the frame area and the multiple clotheslines.

By virtue of its unique design, the inventive clothesline drying apparatus provides a practical, economical solution to the problem of "overcrowding" between a plurality of clotheslines on a conventional drying rack. The pre-defined spacing between taut, adjacent clotheslines ensures maximum utilization of the available drying space.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

Figure 1:
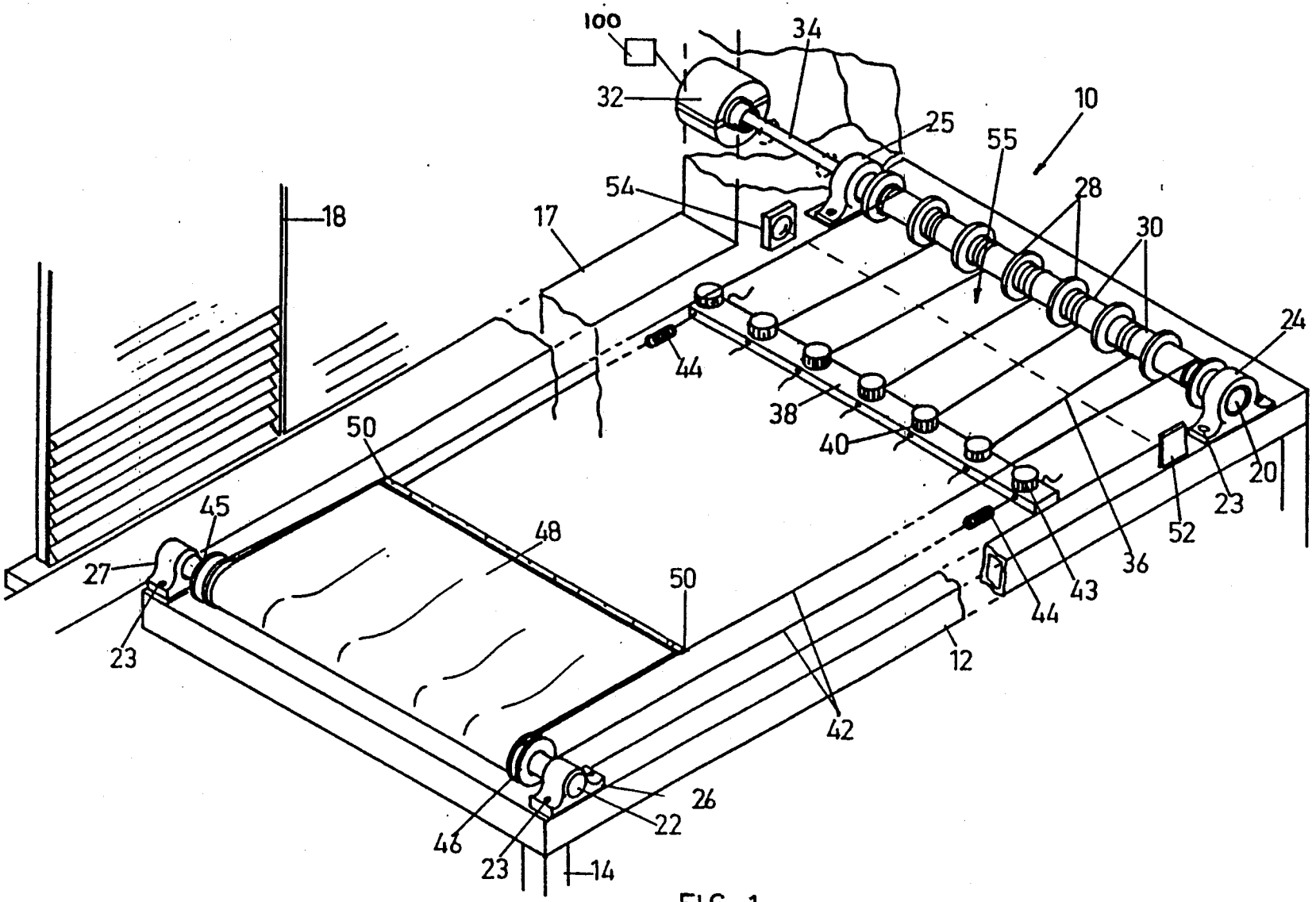
FIG. 1 is a perspective view of a preferred embodiment of a multiple-feed clothesline drying apparatus constructed and operated in accordance with the principles of the present invention.

FIGS. *2a–c* are, respectively, top and cross-sectional side and top views of a movable bar used as a retaining means in the clothesline drying apparatus of FIG. 1;

FIGS. *3a–b* are side views of a shaft for retaining a plurality of clotheslines, showing respectively, the clothesline and cord arrangement, in storage and feed positions;

FIG. *4a* shows a cross-sectional side view of the shaft taken along section lines A—A of FIG. *3b*, and FIG. *4b* shows a cross-sectional side view of an alternative construction of the shaft of FIG. *4a*, featuring an inner shaft;

FIG. *5a–b* show, respectively, cross-sectional side and end views of the shaft (end view taken along section lines B—B of FIG. *5a*), and FIG. *5c* shows an outer end view thereof;

FIGS. *6a–b* show, respectively, a cross-sectional side view and an outer end view of the shaft; and FIGS. *7a–c* show respectively, sectional and top views of a rain cover arranged to automatically cover the clotheslines of FIG. 1 in operation.

DETAILED DESCRIPTION OF THE PREFERRED EMBODIMENTS

Referring now to FIG. 1, there is shown a preferred embodiment of a multiple-feed clothesline drying apparatus 10 constructed and operated in accordance with the principles of the present invention. Apparatus 10 comprises a stationary frame 12, mounted on legs 14 which are supported by an existing, outdoor drying rack (not shown). The drying rack is typically mounted outside a porch or balcony defined by wall 17 and sliding windows 18. With appropriate modification, indoor mounting between opposing walls is possible, eliminating use of frame 12.

Frame 12 is typically provided as a rectangular shape, at respective ends of which there are mounted a pair of shafts 20 and 22. Shaft 20 is supported by bearing supports 24 and 25, which are mounted to frame 12 using mounting hardware 23. Shaft 22 is supported by bearing supports 26 and 27, which are also mounted to frame 12. Shaft 20 has a set of sheaves 28 affixed thereon with pre-defined spacing along its length, such that a plurality of individual portions 30 of shaft 20 are defined.

Figure 6A:
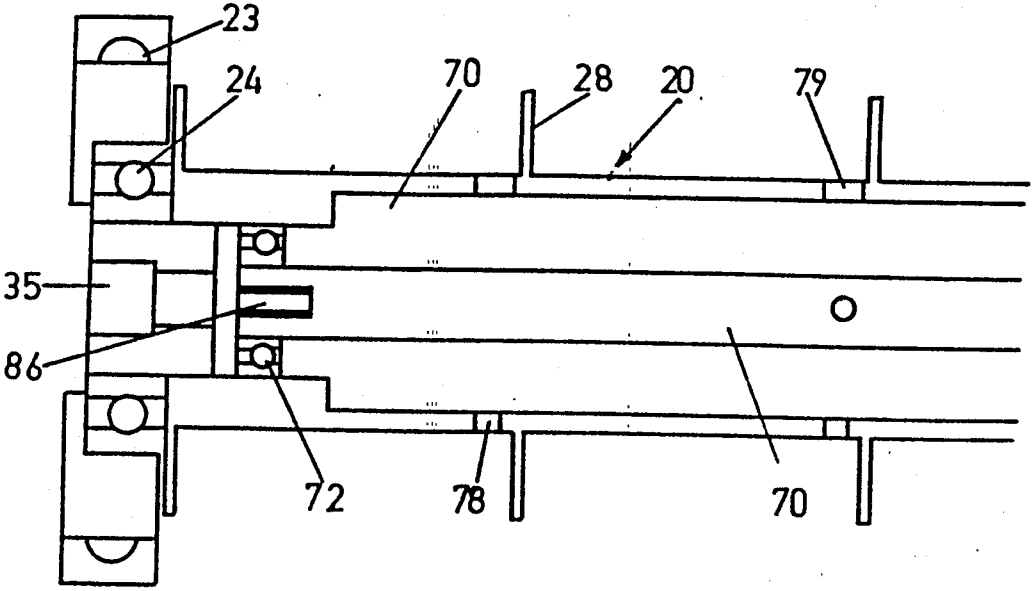
Figure 6B:
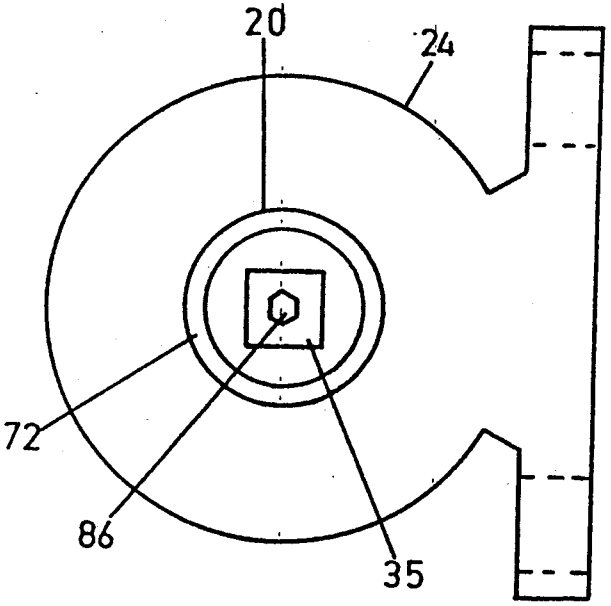

A motor drive mechanism 32 is provided beyond wall 17, and has a drive shaft 34 which is connected via quick connect/disconnect sleeve 35 (FIG. 6) for reversibly-driven rotation of shaft 20. Typically, motor drive mechanism 32 is a reversible motor provided as a self-contained unit, and may include reducing gears for producing a high torque at relatively low speed. Another possible motor is that provided as part of a popular hand-held household tool, such as a cordless screwdriver manufactured by and available from Skil Tools, Model 2000H.

Each of the individual portions 30 of shaft 20 has wound thereon one end of a clothesline 36. The other end of each of clotheslines 36 is terminated in a movable bar 38, via an adjustable tension connector 40. At either end of movable bar 38, there is connected an end of a pair of cords 42, via tension connectors 43. Cords 42 are each loaded with an in-line compensator spring 44, and are looped around a pair of no-slip friction pulleys 45 and 46 which are mounted on shaft 22. Thus, movable bar 38 is supported in free space within the area enclosed by frame 12. The other end of each of cords 42 is wound on a portion 30 of shaft 20, in reverse sense to that of each of clotheslines 36.

A rain cover 48 is provided as a coil on shaft 22, and its free end can be connected at points 50 on the length of cords 42.

In operation, depending on the direction of rotation of shaft 20 as established by motor drive mechanism 32, multiple-feed clothesline drying apparatus 10 simultaneously feeds or retracts multiple clotheslines 36 in coordinated fashion, as movable bar 38 moves away from or towards shaft 20. Thus, available drying space is presented to the user, who may be positioned at one point nearest shaft 20 along the edge of wall 17, such that as clotheslines 36 are fed from shaft 20, they are accessible. Thus, the user need not reposition during feeding.

Controlled feeding and retraction of clotheslines 36 is made possible by conventional motor control circuitry applied to motor drive mechanism 32, which may be operated by a foot pedal (not shown). Alternatively, by a simple grasping and pulling motion of cords 42, movable bar 38 will draw multiple clotheslines 36 toward or away from shaft 20. Provision of a slight downward tilt angle on frame 12 away from shaft 20 assists the feeding operation, as wet laundry items tend to "pull" out additional clothesline feed as they are hung on clotheslines 36.

If it is desired to operate rain cover 48, its free ends are connected to cords 42 at points 50. As shaft 20 feeds clotheslines 36, cords 42 will be wound onto shaft 20, pulling rain cover 48 over the drying space defined by clotheslines 36. As mentioned previously, provision of a slight tilt in frame 12 allows drainage runoff from rain cover 48. An alternate arrangement provides a fixed rain cover 48 over most of frame 12 length, leaving an area near shaft 20 open for clothesline 36 access, with a cover door or flap for this area.

An "electric eye" comprising a light beam 52 and photocell 54 combination may be provided to monitor the zone 55 shown within frame 12. If motor drive mechanism 32 is operated in the reverse direction, clotheslines 36 will be retracted and rewound onto shaft 20. The electric eye functions as a detector which operates to control the operation of motor drive mechanism 32, ensuring that laundry items do not pass beyond this zone, so as not to be accidentally wound onto shaft 20. A delay timer 100 can be applied to operate motor control circuitry at intervals, allowing fully automatic feeding or retraction of clotheslines 36.

Figure 2C:
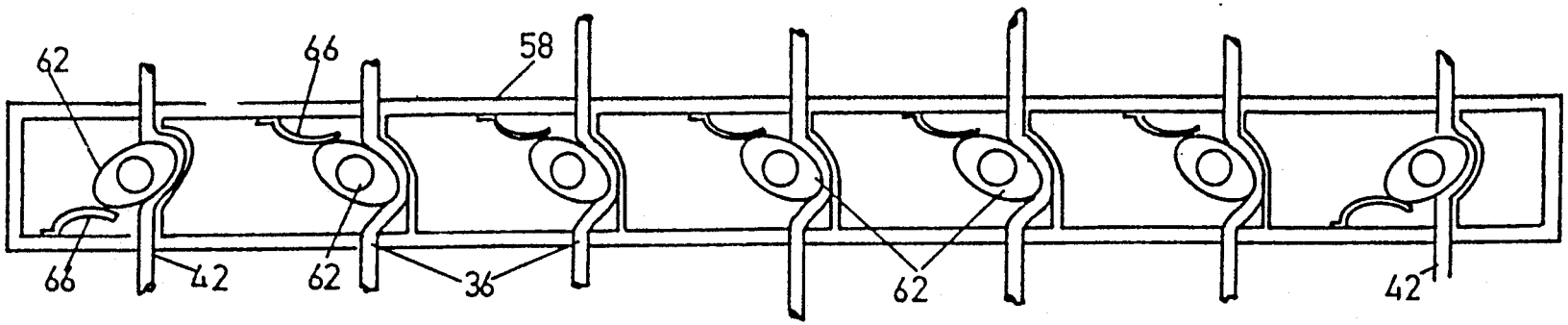
Figure 2B:
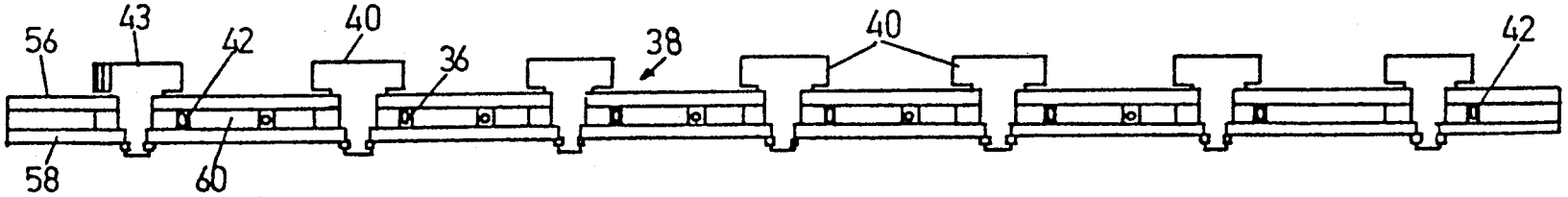
Figure 2A:
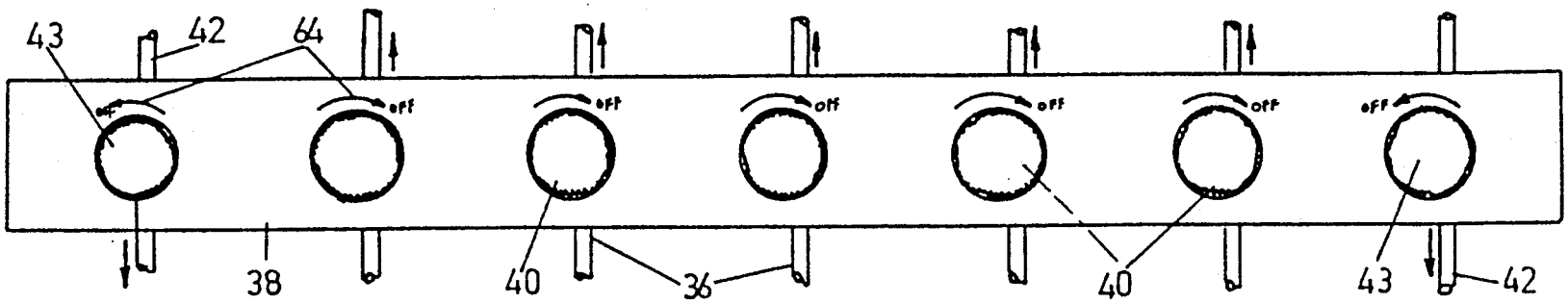

Referring now to FIGS. 2*a–c*, there are shown, respectively, top and cross-sectional side and top views of movable bar 38 used as a retaining means in the clothesline drying apparatus 10 of FIG. 1. Each of tension connectors 40 and 43 is rotatable in movable bar 38, which is constructed of upper and lower sections 56 and 58 (FIG. 2*c*). Clotheslines 36 and cords 42 each pass through a middle section 60 of movable bar 38. Each is locked in position by an eccentrically-shaped notched fitting 62 mounted on each of tension connectors 40, 43.

FIG. 2*a* (top view) reveals arrows 64, which are marked on movable bar 38 to indicate a direction for releasing tension connectors 40 and 43, by rotation of notched fittings 62. A spring leaf 66 retains each of notched fittings 62 in the locked position, until the ends of each of clotheslines 36 and cords 42 are pulled, releasing notched fitting 62 and allowing easy tension adjustment.

Figure 3A:
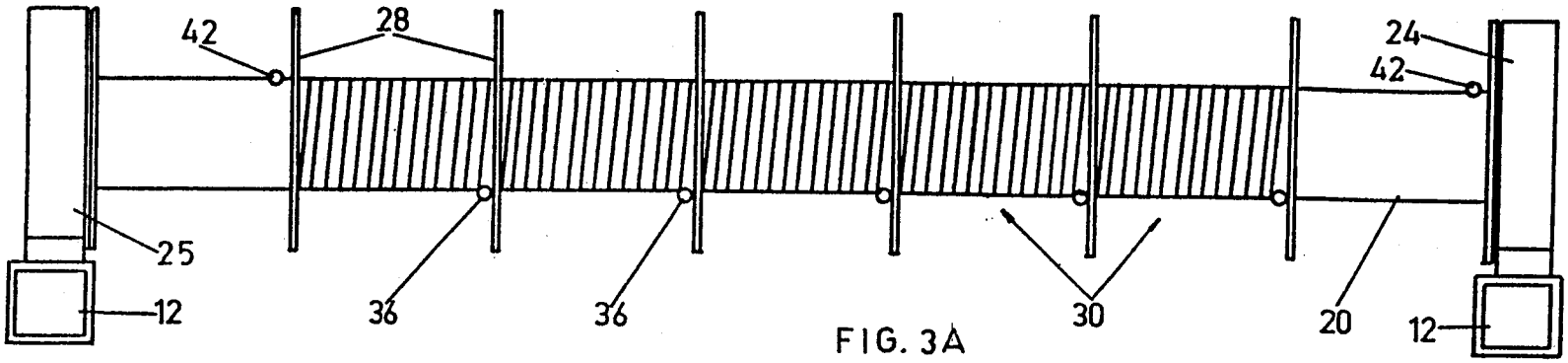
Figure 3B:
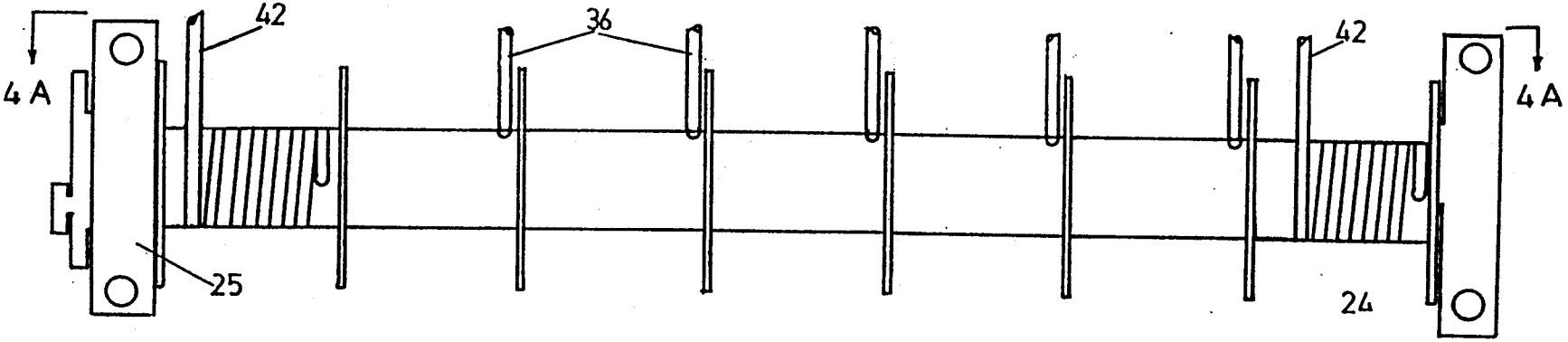

In FIGS. 3*a–b*, there are shown side views of shaft 20 illustrating, respectively, the clothesline 36 and cord 42 arrangement, in storage and feed positions. As stated previously, since each of clotheslines 36 and cords 42 are wound in reverse sense, as one is fed from shaft 20, the other is retracted and wound onto shaft 20. In an alternative embodiment, only one cord 42 is provided in the middle of shaft 20, and the ends of movable bar 38 are adapted to ride on frame 12 for stability.

Figure 4A:
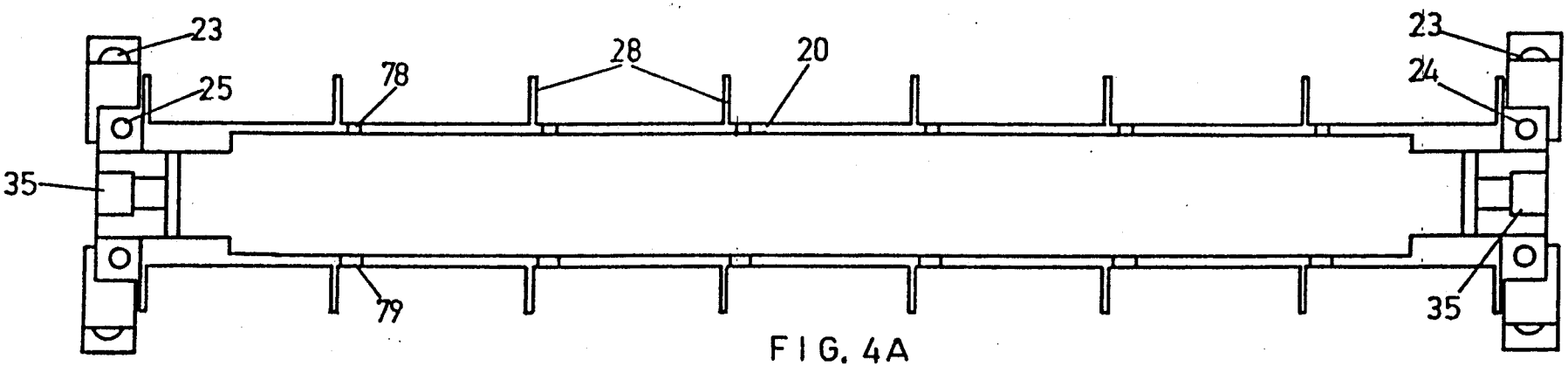
Figure 4B:
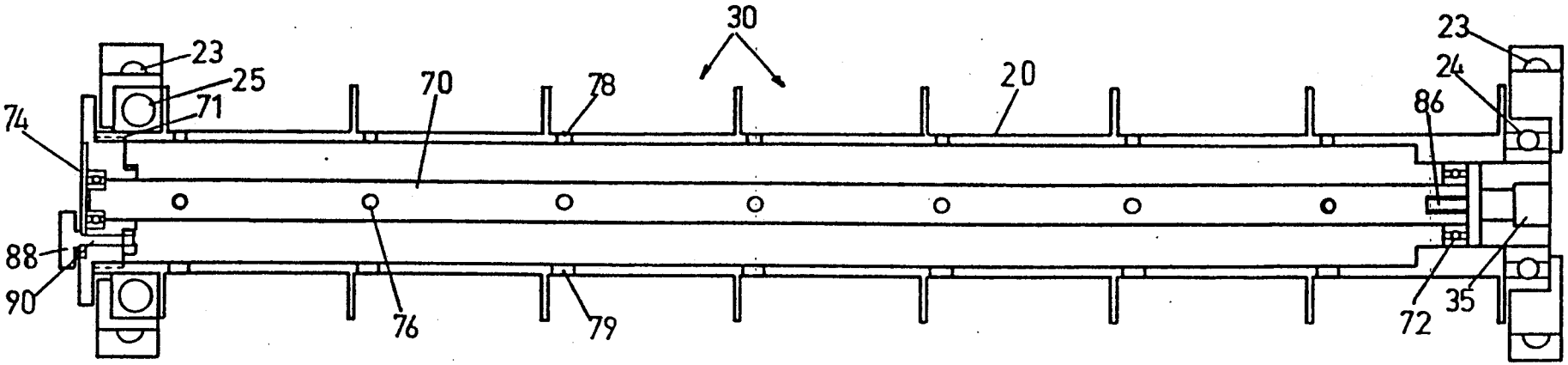

Turning now to FIG. 4*a*, there is shown a cross-sectional side view of shaft 20 taken along section lines A—A of FIG. 3*b*, revealing further construction details. FIG. 4*b* shows an arrangement in which an inner shaft 70 having threads 71 is mounted within the hollow interior of shaft 20. Inner shaft 70 is supported on bearings 72 and 74, and has holes 76 formed therein corresponding to portions 30 of shaft 20. As shown in FIGS. 4*a–b*, shaft 20 also has small and large holes 78 and 79. Each of clotheslines 36 can be threaded through small hole 78, then hole 76 and out through large hole 79, where it is tied with a knot, and again slipped through large hole 79 where it is unseen (FIG. 3*a*).

Alternatively, cords 42 are tied to inner shaft 70 holes 76 correponding to end portions 30 on shaft 20. (FIG. 3*b*). Thus, either of clotheslines 36 or cords 42 is tied to inner shaft 70.

Figure 5C:
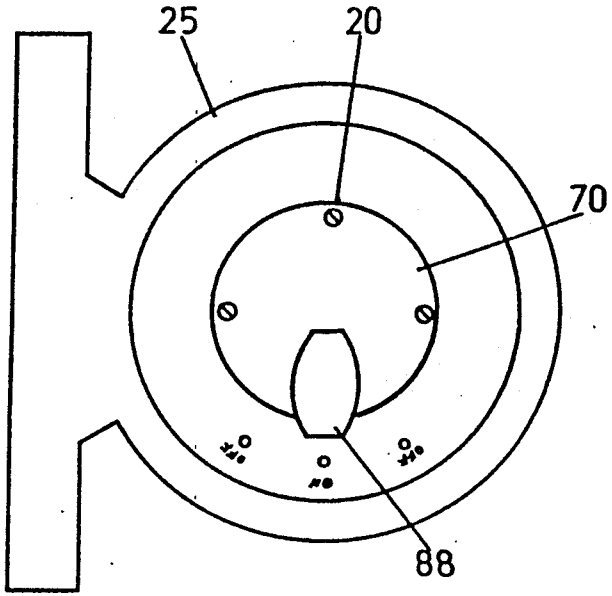
Figure 5A:
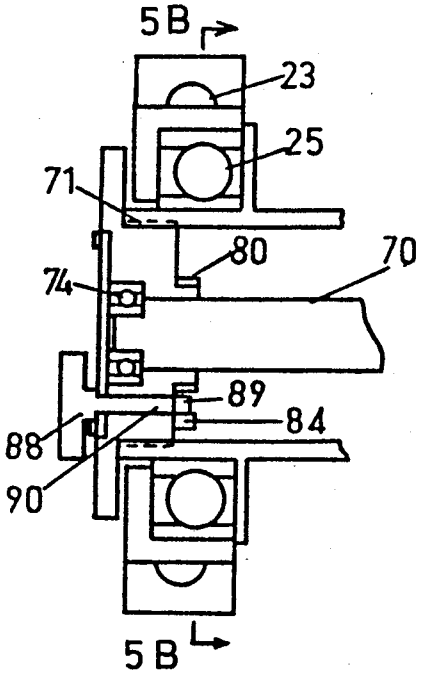
Figure 5B:
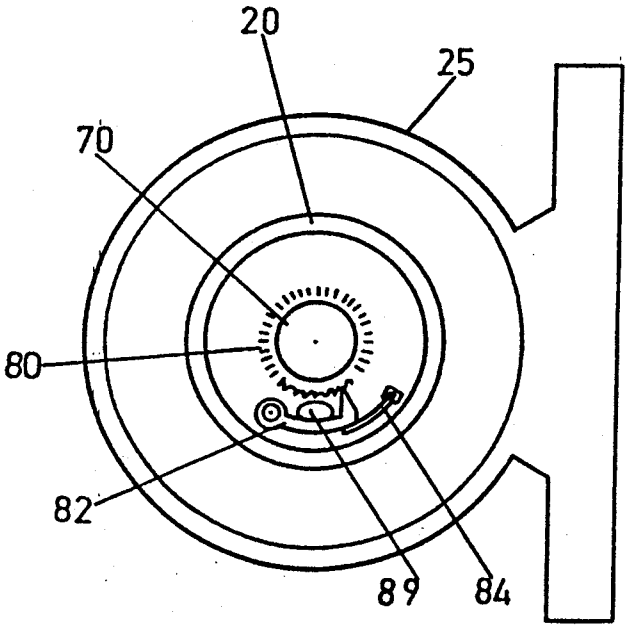

As best seen in FIGS. 5*a–c*, a ratchet 80, pawl 82 and spring 84 combination are provided on the end of inner shaft 70 which is supported by bearing 74 and bearing support 25. FIG. 5*b* is a cross-sectional end view taken along section lines B—B of FIG. 5*a*. A hexagonal sleeve 86 (FIG. 6) on the end of inner shaft 70 which is supported by bearing 72 allows for it to be rotated, and by action of ratchet, pawl and spring combination 80–84, this rotation is allowed in one direction only. Thus, regardless of whether clotheslines 36 or cords 42 are tied on inner shaft 70, they can all be tightened at once, rather than individually. In this respect, this arrangement is different than that of tension connectors 40, 43.

As will be understood, before the tightening of either of clotheslines 36 or cords 42 on inner shaft 70, shaft 20 is rotated so that these are aligned with the axis passing through the center of small hole 78, to permit easy winding.

Reduction in the tension provided by the arrangement of inner shaft 70 can be effected by turning of release knob 88, which turns on pin 90 and rotates eccentrically-shaped cam 89 in either direction, moving spring 84 to release pawl 82 from ratchet 80. This feature is useful during initial set up and/or during replacement of several clotheslines 36. In the case of a single cord 42 wound on the middle of shaft 20, tightening by use of inner shaft 70 becomes a simple task.

Figures 7A, 7B, 7C:
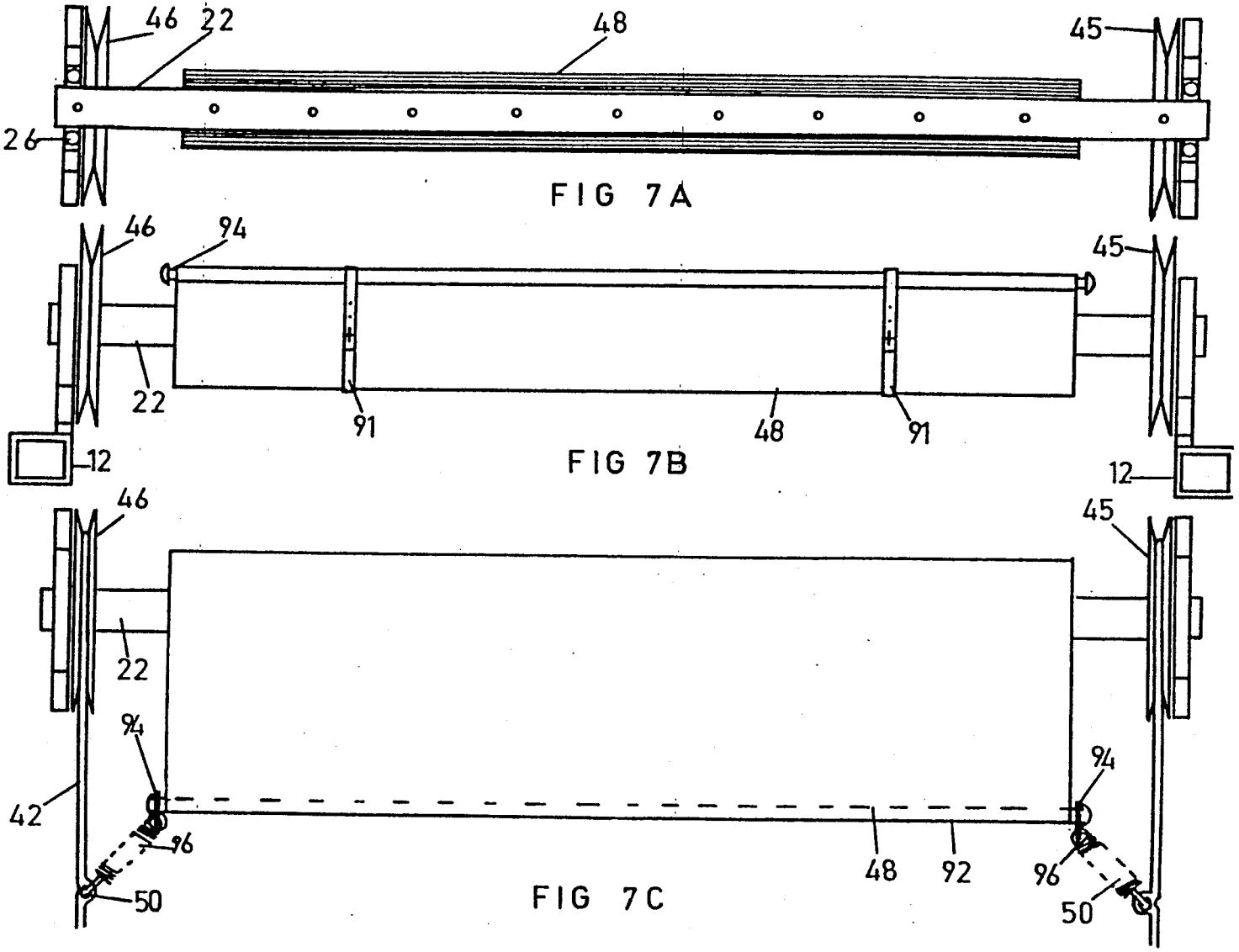

Referring now to FIGS. 7*a–c*, there are shown sectional and top views of rain cover 48 arranged to automatically cover clotheslines 36 during an operation in which the latter are fed from shaft 20. When open (FIG. 7*b*), rain cover 48 is coiled about shaft 22 and held by clips 91. At the free end of rain cover 48, there is retained a pin 92 which extends the width of rain cover 48.

In FIG. 7*c*, the head 94 of pin 92 is shown attached by way of a spring 96 to point 50 on cord 42. As stated previously, rain cover 48 operation is automatic by virtue of its attachment to cords 42, which move in a direction opposite to that of clotheslines 36.

It will be appreciated that a practical and economical construction of apparatus 10 may be achieved through the application of skill of the art mechanical design techniques. In addition, control of motor drive mechanism 32 is within skill of the art electrical design techniques, and this may be provided via a foot pedal control, or an electrical panel layout for fingertip control, or a combination of both. A flywheel drive can be supplied as a manual option replacing motor 32.

In summary, the multiple-feed clothesline drying apparatus 10 of the present invention provides a new and useful design for bringing available drying space on multiple clotheslines within easy reach of the user. By virtue of its unique design, the invention clothesline drying apparatus eliminates the problem of "overcrowding" between a plurality of clotheslines on a conventional drying rack. The pre-defined spacing between taut, adjacent clotheslines ensures maximum utilization of the available drying space.

Having described the invention with regard to certain specific embodiments thereof, it is to be understood that the description is not meant as a limitation since further modifications may now suggest themselves to those skilled in the art and it is intended to cover such modifications as fall within the scope of the appended claims.

I claim:

1. A multiple-feed clothesline drying apparatus comprising:

a first shaft supported for rotation at the ends thereof;

a plurality of adjacent clotheslines each having a first end and a second end, said first end wound about a portion of said first shaft along adjacent selected portions of the length of said first shaft;

means for retaining the second end of each of said clotheslines, said retaining means having attached to at least a first point thereon a first end of a flexible cord, a second end of said flexible cord being wound about said first shaft in opposite sense to that of said clotheslines along a second portion of the length of said first shaft; and drive means operable to rotate said first shaft in take-up and feed operations for simultaneously retracting and feeding said plurality of clotheslines in coordinated fashion such that said retaining means moves toward and away from said first shaft in accordance with said take-up and feed operations, and wherein each one of said plurality of clotheslines is connected to said retaining means, said retaining means further comprising adjustment means for maintaining said adjacent ones of said plurality of clotheslines taut and eliminating interference with one another.

2. The apparatus of claim 1 further comprising a frame having first and second opposed ends, said first shaft supported at said first end of said frame, said flexible cord being looped about a pulley supported at said second end of said frame.

3. The apparatus of claim 2 further comprising a rain cover coiled about a second shaft supported by said second end of said frame, said rain cover being connected to said flexible cord so that it moves in a direction opposite that of said plurality of clotheslines during said take-up and feed operations thereby automatically feeding said rain cover over said frame.

4. The apparatus of claim 2 wherein said retaining means comprises a movable bar having a pair of said flexible cords the first end of which is connected at either end thereof, said second end of said frame supporting a pair of pulleys, the free end of each of said cords being looped around respective ones of said pair of pulleys such that movement of said cords adjusts the position of said movable bar toward and away from said shaft in accordance with said take-up and feed operations.

5. The apparatus of claim 4 wherein said drive means comprises a flywheel drive arranged for manual use.

6. The apparatus of claim 4 wherein said drive means comprises a motor drive mechanism for rotating said first shaft.

7. The apparatus of claim 6 further comprising a photoelectric detector connected to said frame for sensing passage of laundry items supported on said clotheslines through a zone within the area enclosed by said frame, said photoelectric detector controlling operation of said motor drive mechanism to ensure that said laundry items do not pass beyond said zone and are not wound onto said first shaft.

8. The apparatus of claim 6 further comprising a delay timer for operating said motor drive mechanism at intervals during said feeding and retraction operations of said plurality of clotheslines.

9. The apparatus of claim 1 further comprising a second shaft contained within said first shaft, said second shaft having said first end of said clotheslines tied thereto and being arranged for independent rotation in one direction only, such that by rotation of said second shaft in said one direction, said clotheslines are tightened against said flexible cord as needed.

10. The apparatus of claim 1 further comprising a second shaft contained within said first shaft, said second shaft having said second end of said flexible cord tied thereto and being arranged for independent rotation in one direction only, such that by rotation of said second shaft in said one direction, said flexible cord is tightened against said clotheslines as needed.

11. A method of operating multiple-feed clothesline drying apparatus comprising the steps of:

providing a plurality of adjacent clotheslines each having a first end and a second end, said first end wound about adjacent selected portions of the length of a first shaft supported for rotation;

retaining the second end of each of said clotheslines by means having attached to at least a first point thereon one end of a flexible cord, a second end of said flexible cord being wound about said first shaft in opposite sense to that of said clotheslines along a second portion of the length of said first shaft; and rotating said first shaft in take-up and feed operations for simultaneously retracting and feeding said plurality of clotheslines in coordinated fashion such that said retaining means moves toward and away from said first shaft in accordance with said take-up and feed operations, and wherein each one of said plurality of clotheslines is connected to said retaining means, said retaining means further comprising adjustment means for maintaining said adjacent ones of said plurality of clotheslines taut and eliminating interference with one another.

12. The method of claim 11 further comprising the step of rotating a second shaft contained within said first shaft, said second shaft having said first end of said clotheslines tied thereto and being arranged for independent rotation in one direction only, such that by rotation of said second shaft in said one direction, said clotheslines are tightened against said flexible cord as needed.

13. The method of claim 11 further comprising the step of rotating a second shaft contained within said first shaft, said second shaft having said second end of said flexible cord tied thereto and being arranged for independent rotation in one direction only, such that by rotation of said second shaft in said one direction, said flexible cord is tightened against said clotheslines as needed.

14. The method of claim 11 wherein said rotating step is performed at periodic intervals under power of an automatically-controlled motor drive mechanism.

* * * * *